US005207479A

United States Patent [19]

Wickman et al.

[11] Patent Number: 5,207,479

[45] Date of Patent: May 4, 1993

[54] CHAIR CONTROL MECHANISM

[75] Inventors: Dennis J. Wickman; Dennis R. Motz, both of Jasper; Steven F. Trinkel, Rockport, all of Ind.

[73] Assignee: Kimball International, Inc., Jasper, Ind.

[21] Appl. No.: 534,034

[22] Filed: Jun. 6, 1990

[51] Int. Cl.[5] ..... A47C 1/00

[52] U.S. Cl. ..... 297/302; 297/304

[58] Field of Search ..... 297/302, 304, 301, 300

[56] References Cited

U.S. PATENT DOCUMENTS 4,575,150 3/1986 Smith ..... 297/301
4,711,491 12/1987 Ginat ..... 297/301
4,718,726 1/1988 Estkowski et al. ..... 297/300
4,796,950 1/1989 Mrotz, III et al. ..... 297/302
4,858,993 8/1989 Steinmann ..... 297/304
4,889,385 12/1989 Chadwick et al. ..... 297/302
4,909,472 3/1990 Piretti ..... 297/301
4,966,411 10/1990 Katagiri et al. ..... 297/304

*Primary Examiner*—Kenneth J. Dorner
*Assistant Examiner*—Cassandra L. Hope
*Attorney, Agent, or Firm*—Baker & Daniels

[57] ABSTRACT

The present invention is an office chair capable of dynamically tilting to provide a desired seat inclination from an upright position to a maximum tilted position. The preloading mechanism of the spring includes an adjusting screw and a tension arm which provides leverage. The leverage of the preloading mechanism facilitates turning the adjusting screw to vary the preloaded tension of the springs. Also, a spindle cover is provided to stop movement of the seat at the maximum tilted position, and to stop movement of a toggle mechanism at the upright position.

18 Claims, 3 Drawing Sheets

CHAIR CONTROL MECHANISM

BACKGROUND OF THE INVENTION

The present invention relates to chairs, particularly to office chairs of the type which recline. More specifically, the field of the invention is that of knee tilt control mechanisms for office chairs.

A problem with prior art tilting chairs involves the position of the chair occupant's feet. When a chair seat is tilted about an axis located in the middle of the seat, the rear of the seat is lowered simultaneously with the elevation of the front. The occupant's knee is normally located adjacent to the front of the seat, so that when the front rises so do the occupant's legs thereby causing the feet to be lifted above the ground. This lifting of the legs above the floor is undesirable and many prior art chair structures exist which attempt to solve this problem.

In one prior art chair design, a tilting axis is provided near the front of the seat so that when the chair is tilted, the front edge of the seat remains at relatively the same height above the ground. With such an arrangement, the occupant's legs are not lifted above the ground because the tilting occurs about an axis in the vicinity of the knees. However, prior art knee tilt control mechanisms have problems associated with the amount of resistance against tilting. For example, a high resistance spring causes tilting, particularly in positions of near full tilt, to be unnecessarily difficult as the linear increase of resistance may be too strong for many persons. Further, a low resistance spring causes unwanted tilting because the initial force of the occupant's body sitting down biases the seat in a substantial backward tilt, which is an undesirable position when working at a desk or table.

To overcome the above mentioned problems, one prior art chair includes a mechanical lock for maintaining an upright position. To recline in this chair, the occupant must first unlock the mechanism before reclining. Similarly to return to the upright position, the occupant must move to and then lock the chair in the upright position. The mechanical lock detracts from the comfort and flexibility of the chair because the chair occupant must operate the lock to adjust the position of the chair.

Another prior art chair includes a passive knee tilt mechanism, i.e., a mechanism which responds to the positioning of the occupant. The passive knee tilt mechanism provides a high initial resistance to tilting and then a generally increasing resistance for the remainder of the possible tilting angle. Because of the high initial resistance, the occupant will be in the upright position unless the occupant exerts a backward force. Further, with the exertion of a reasonable amount of force the occupant can easily recline. The knee tilt mechanism includes two springs, one providing a linear resistance to tilting and the other attached to a cam lever so that at a predetermined angle the compression of the other spring remains relatively constant.

Having the tilt axis positioned in front of the spindle axis of a chair allows the seat to recline and potentially impact the spindle hub. The resistance of the springs limit the tilting of the chair. However, a significantly large force can overcome the resistance of the springs, for example a relatively large person falling backwards into the seat.

Another chair which is disclosed in U.S. Pat. No. 4,858,993 has a passive knee tilt mechanism including a spring and a toggle lever. The spring provides a linearly increasing resistance to tilting, and the toggle lever provides a non-linear resistance which at a predetermined angle initially increases sharply then gradually decreases from the maximum level. The spring is adjusted by rotation of a knob connected to a flexible shaft which is threadedly connected to an upper portion of the spring support, the upper portion engaging and moving on a cam guide of the seat. The toggle lever also includes a means for adjusting the angle at which the toggle lever begins to provide resistance so that the chair rests at that angle. However, movement of the spring support in the cam guide must overcome the frictional resistance of the cam surface. Also, the flexible shaft may be less reliable than a directly connected adjusting screw for adjusting the spring.

One feature common to most office chairs having springs involves adjusting the chairs, resistance to tilting. Prior art spring adjustment mechanisms generally use either direct acting or sliding wedge types of adjustment. One type of chair structure uses a direct acting adjustment mechanism wherein an adjustment knob mechanism acts along the centerlines of springs to make the adjustments. Turning the knob is difficult because the spring and friction forces directly resist the axial movement of the knob. Another direct acting adjustment involves double torsion springs, wherein a knob mechanism acts on one of the arms of the spring. Turning the knob is slightly less difficult than with a single spring because some leverage is provided by the structure of the double torsion spring; however, the mechanical advantage gained by double torsion spring structure provides only a marginal improvement, below a 2:1 leverage. Prior art sliding wedge arrangements include a wedge driven by an adjusting screw to compress the springs. Turning the knob is facilitated by the leverage of the wedge and resisted by the friction between wedge surfaces, thus creating a net effect which differs little from direct acting adjustment arrangements.

What is needed is a tiltable chair which is easier to adjust and has an adjustment mechanism which utilizes a greater amount of leverage. Also, a tiltable chair having a more effective positive stop is needed.

SUMMARY OF THE INVENTION

The present invention is an improved adjustment mechanism for preloading the tilting resistance of a tiltable chair. The adjustment mechanism provides significant leverage so that the preloaded tension on the chair's springs is more easily changed. Also, the chair of the present invention includes a positive stop on the top of the spindle to limit the range of possible tilting of the chair seat without damaging the spindle.

The adjustment mechanism of the present invention adjusts the resistance of two springs which are disposed between two plates of a V-shaped tilt control assembly. The adjustment mechanism includes an adjusting screw and a tension arm. The tension arm pivots on one of the plates, with the adjusting screw threadedly connected to the tension arm and the spring engaging another portion of the tension arm. The distance between the screw connection and the pivot is significantly greater than the distance between the spring engagement portion and the pivot, thus providing leverage to facilitate the adjustment of the spring resistance.

The springs of the present invention include axially located guide pins and arcuately shaped spring guides at the ends. The one end engages the tension arm and the other engages one of the plates. The chair also includes a toggle mechanism for providing increased initial resistance against tilting. One arm of the toggle is attached to the seat plate and the other to the base plate, with a spring biasing the arms to the upright position.

The chair of the present invention also includes a spindle cover for limiting the tilting movement of the seat. The spindle cover limits downward tilting by providing a positive stop for the bottom of the seat. In addition, the spindle cover limits forward tilting by providing a positive stop to an arm of the toggle mechanism. Also, the control lever for a hydraulic or pneumatic lifting system is guided by the spindle cover.

The spindle cover is also preferably provided with a stop cushion having a top portion for dampening the noise and vibration incident to the impact of the seat bottom and spindle cover when moved to the maximum tilted position. Also, an edge portion of the stop cushion dampens noise and vibration incident to the impact of the toggle arm and the spindle cover when moved to the upright position.

The present invention is, in one form, a chair including a base, a seat, a V-shaped tilt control assembly, springs, and an adjustment device. The base includes a vertically extending support column. The seat includes a back portion and a bottom portion with a front edge, with the seat capable of being positioned in an upright position and a plurality of rearward tilted positions. The V-shaped tilt control assembly includes a main pivot, a base plate attached to the column, and a seat plate attached to the seat, with the base plate and the seat plate being operatively connected by the main pivot which is generally horizontally disposed in the vicinity of the front edge. A first spring is operatively connected between the base plate and the seat plate for uniformly resisting tilting by the seat. A second spring is operatively connected between the base plate and the seat plate for variably resisting tilting by the seat wherein the second spring provides a relatively high initial resistance against tilting the seat in the upright position and provides a relatively low resistance against tilting the seat in one of the tilted positions. The adjustment mechanism adjusts the resistance of the first spring and includes an adjusting screw and a tension arm. The tension arm has a pivot, a spring engagement portion, and a threaded connection between the adjusting screw and the tension arm, with the tension arm pivot engaged with one of the plates of the V-shaped tilt control assembly. Rotation of the adjusting screw causes movement of the tension arm. The distance from the tension arm pivot to the threaded connection is greater than the distance from the tension arm pivot to the spring engagement portion thereby facilitating movement of the adjusting screw by the leverage of the tension arm.

The present invention is, in another form, a chair including a base, a seat, a V-shaped tilt control assembly, springs, and a cover. The base includes a vertically extending support column having an upper end. The seat includes a back portion and a bottom portion having a front edge and which is capable of being positioned in an upright position and a plurality of tilted positions including a maximum tilted position. The V-shaped tilt control assembly includes a main pivot, a base plate attached to the column, and a seat plate attached to the seat, with the base plate and seat plate being operatively connected by the main pivot which is generally horizontally disposed in the vicinity of the front edge. The springs resist tilting by the seat and are operatively connected between the base plate and seat plate. The cover limits the tilting movement of the seat and is located at the upper end of the column. The cover includes a spindle cover disposed under the seat plate such that the spindle cover stops movement of the seat at the maximum tilted position. The cover may additionally including a guide for a control lever of a hydraulic or pneumatic lifting device in the column.

Also, the cover may include a stop cushion having a top portion which absorbs vibration and noise incident when the seat plate moves to the maximum tilted position. The chair may also include a toggle mechanism to link the plates, and the stop cushion may also have an edge portion to dampen noise and vibration when the toggle mechanism moves to the upright position.

One object of the present invention is to provide a tiltable chair which is easier to adjust.

A further object is to provide an adjustment mechanism which utilizes a greater amount of leverage.

Another object is to provide a tiltable chair having a positive stop.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplifications are not to be construed as limiting the scope of the invention in any manner.

DESCRIPTION OF THE PREFERRED EMBODIMENT

Figure 2:
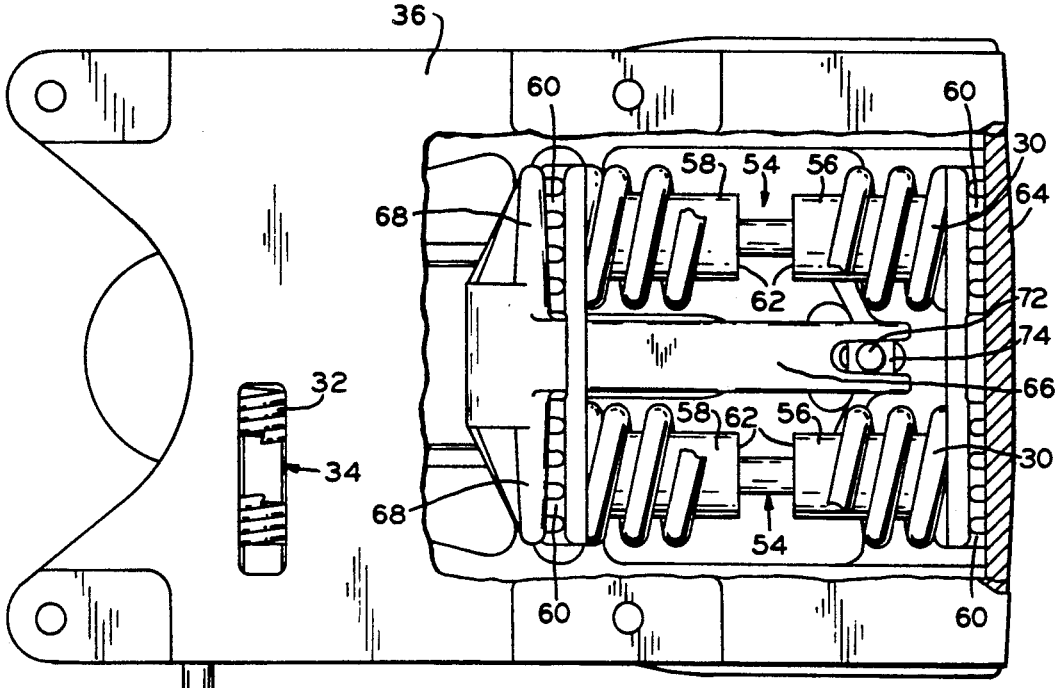
FIG. 2 is a top view, in partial cut-away, of the tilt control mechanism.
Figure 1:
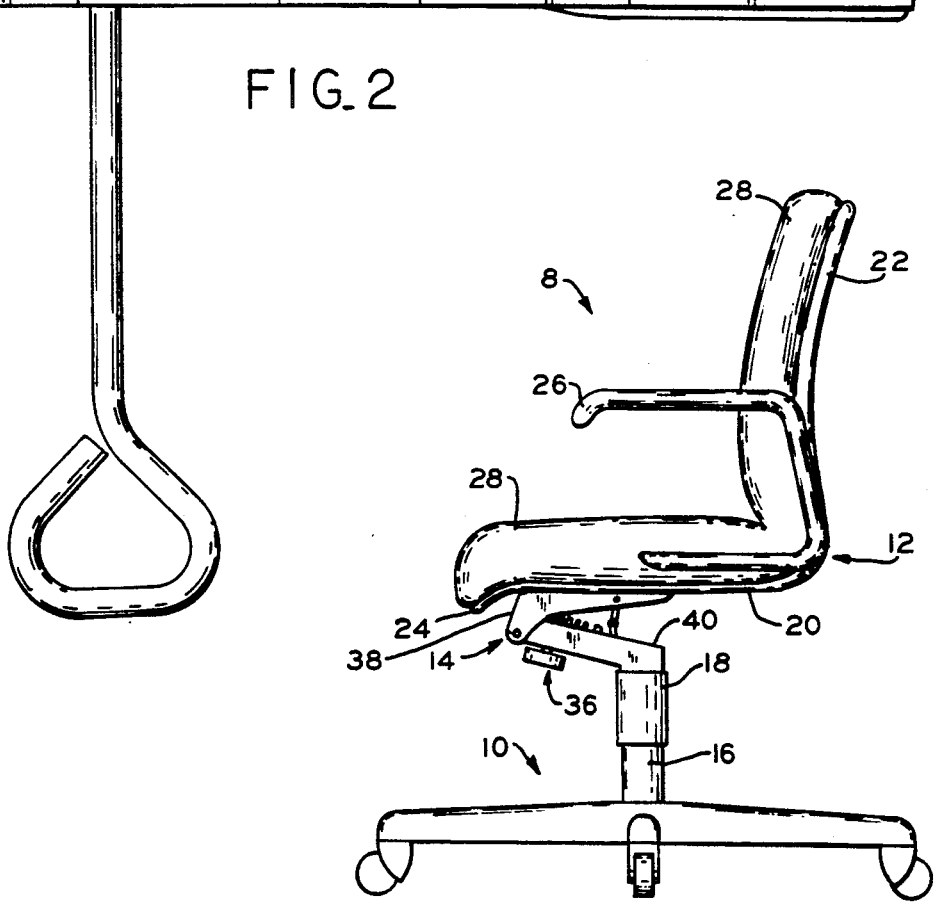
FIG. 1 is a side elevational view of the chair having the tilt control mechanism of the present invention.

The present invention is a chair control mechanism for desk, task, and other chairs, such as chair 8 of FIG. 1. Chair 8 includes base portion 10, seat portion 12, and tilt control assembly 14 which has a V-shape and connects base 10 to seat 12. Base 10 includes upwardly extending support column 16. Spindle 18 is disposed at the top of support column 16 and attached to tilt control assembly 14 which can thereby rotate about an axis defined by column 16. Assembly 14 is also attached to bottom portion 20 of seat 12 which can thereby tilt from an upright position (FIGS. 1, 3, and 5) to a maximum tilted position (FIGS. 4 and 6). Seat 12 also includes back portion 22, front edge 24, arm rest 26, and seat cushions 28.

Figure 3:
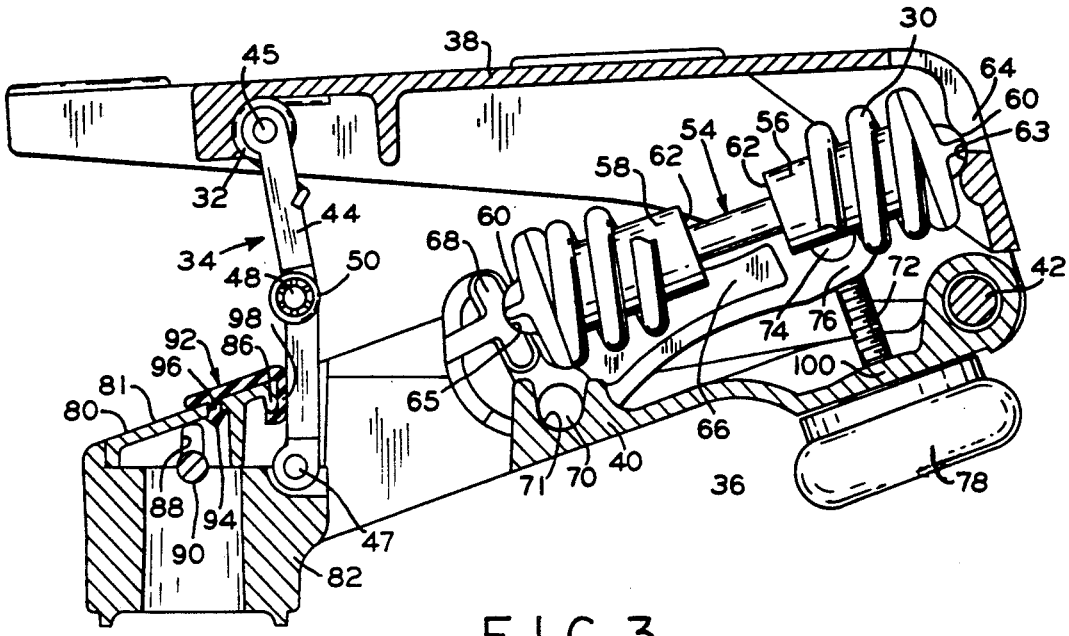
FIG. 3 is a side view, in cross-section, of the control mechanism at the low tension setting positioned in the upright position.
Figure 4:
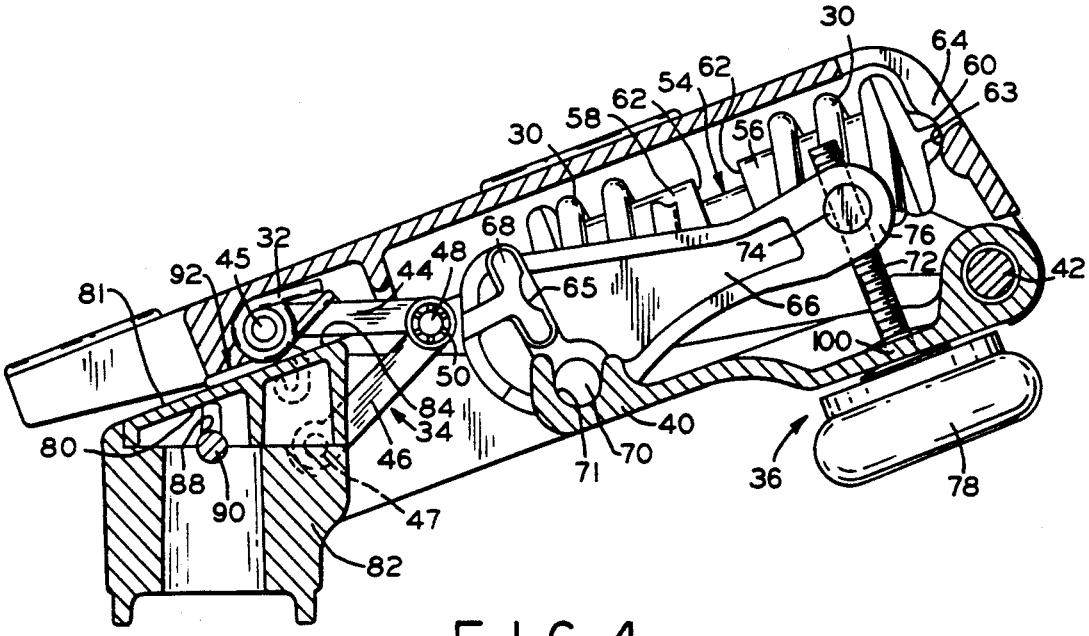
FIG. 4 is a side view, in cross-section, of the control mechanism at the low tension setting positioned in the maximum tilted position.
Figure 5:
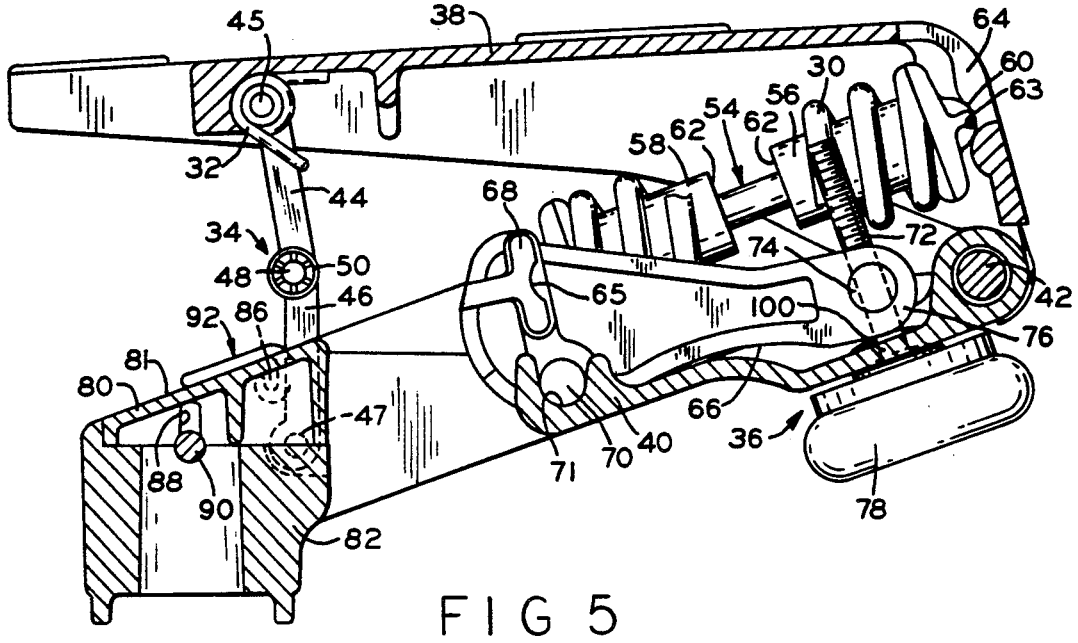
FIG. 5 is a side view, in cross-section, of the control mechanism at the high tension setting positioned in the upright position.
Figure 6:
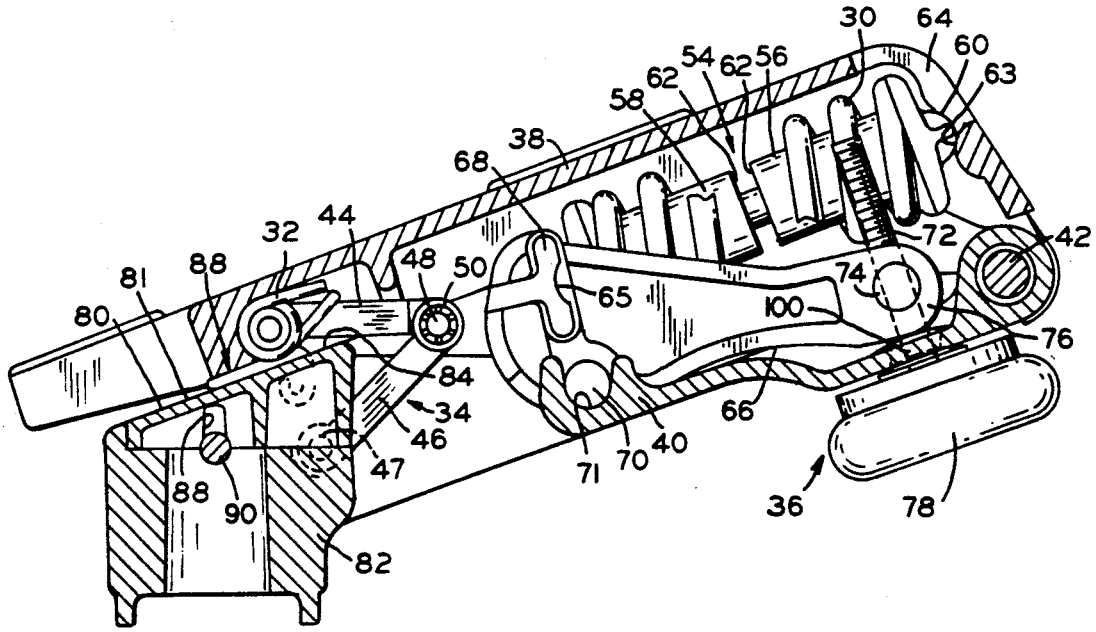
FIG. 6 is a side view, in cross-section, of the control mechanism at the high tension setting positioned in the maximum tilted position.

Tilt control assembly 14 initially provides a relatively high resistance to tilting of seat 12 by means of preloaded springs 30 and toggle spring 32 of toggle mechanism 34, see FIGS. 2–6. The preloaded compression of springs 30 may be altered by adjustment mechanism 36. Toggle mechanism 34 connects seat plate 38 and base plate 40 generally above spindle 18. Plates 38 and 40 are pivotally connected by elongated main pivot 42 which extends under seat 12 near front edge 24. Springs 30 and 32 urge seat plate 38 to an upright position as shown in FIGS. 3 and 5.

Toggle mechanism 34 also includes upper toggle arm 44 connected to plate 38 by pivot 45 and lower toggle arm 46 connected by pivot 47 to plate 40, and which are both rotatably connected to pivot 48 and engaged by retaining ring 50. Toggle spring 32 extends around pivot 45 and engages upper toggle arm 44. Arms 44 and 46, in the upright position, are disposed at an angle slightly less than 180° facing opposite main pivot 42, preferably about 170°. The initial resistance of toggle spring 32 is relatively high, because each initial change of degree in the tilt angle exerts much more force on spring 32 than each change of degree when nearly in the maximum tilted position of FIGS. 4 and 6. In the preferred embodiment, toggle mechanism 34 exerts a moment of about 220 in-lbs. in the upright position which decreases to about 65 in-lbs. in the maximum tilted position. The actual force of toggle mechanism 34 decreases rapidly, then is generally constant before increasing during the rearmost half of the tilt range.

Compression springs 30 provide a linearly increasing resistance against tilting seat 12. Each spring 30 is associated with a guide pin 54 having a front and rear spring guide 56 and 58, respectively, slidably connected to at least one of guides 56 or 58. Each spring guide includes an arcuate end 60 and an inner end 62. Front spring guide 56 pivotally engages arcuate surface 63 on grooved portion 64 of seat plate 38. Rear spring guide 58 pivotally engages arcuate surface 63 on tension arm 66 of adjusting mechanism 36 (FIG. 3). In the preferred embodiment, springs 30 each have a preloaded compression force of about 275 to 410 lbs. in the chair's upright position.

In accordance with the present invention, adjustment mechanism 36 alters the preloaded compression on springs 30. Grooved spring engaging portion 68 of tension arm 66 can move about arm pivot 70 received in groove 71, which allows spring 30 to alter its compression. Screw 72 can move tension arm 66 by virtue of its threaded connection with threaded cross dowel 74. End 76 of tension arm 66 rotatably receives dowel 74 so that downward movement of dowel 74 causes an increase in the compression of springs 30 and upward movement of dowel 74 causes a decrease in their compression. Preferably, tension arm 66 and dowel 74 are made from steel, or other suitable materials such as aluminum, brass, or plastic. Knob 78, located adjacent to base plate 40, is attached to screw 72 and allows for manual adjustment of mechanism 34.

By rotation of screw 72, tension arm 66 can be positioned in a low tension position (FIGS. 3 and 4) or a high tension position (FIGS. 5 and 6). The torque necessary to turn screw 72 is much less than the torque required to directly compress springs 30. The lower torque is a consequence of leverage provided by tension arm 66. In the preferred embodiment, the distance from dowel 74 to arm pivot 70 is about three (3) times the distance from arcuate surface 65 of spring engaging portion 68 to arm pivot 70. This three to one ratio (3:1) provides a mechanical advantage which greatly facilitates manual adjustment of the preloaded resistance of springs 30. Also, screw 72 preferably has a pitch of twenty-four (24) threads per inch.

In accordance with another aspect of the present invention, spindle 18 is protected by spindle cover 80, having an angled upper surface 81, and which is disposed over spindle cap portion 82 of base plate 40. As shown in FIGS. 4 and 6, top surface 84 of cover 80 provides a positive down-stop against the backward tilting of seat plate 38. Also, edge portion 86 provides a positive up-stop against toggle mechanism 34 in the upright positions (FIGS. 3 and 5). Cover 80 also provides a guide slot 88 for a control lever 90 of a hydraulic or pneumatic lifting device (not shown) in spindle 18.

In the preferred embodiment, stop cushion 92 is provided to dampen noise and vibration which would otherwise occur upon contact of plates 38 and 40. Preferably, stop cushion 92 is made of a resilient material with sufficient flexibility to fit over and engage edge portion 86, such as thermoplastic, elastomer, or rubber. Barbed flange 94 extends into aperture 96 and front edge flange 98 extends around edge portion 86 to fit over and secure cushion 92 on spindle 80 (see FIG. 3). By fitting over edge portion 86 as well as extending over a portion of top surface 84, stop cushion 92 serves as a buffer between seat plate 38 and cover 80 as well as between toggle mechanism 34 and cover 80.

In operation, chair 8 can be set with a variety of preloaded compressive forces for springs 30. For example, a relatively low tension position is shown in FIGS. 3 and 4, wherein tension arm end 76 is spaced away from knob mounting portion 100 of base plate 40. The low tension position can be altered by turning knob 78, which moves dowel 74 and end 76 by virtue of the threaded engagement with screw 72. A relatively high tension position is shown in FIGS. 5 and 6 wherein tension arm end 76 abuts portion 100. The difference between the low and high tension positions is the preloaded compression defining distance between front spring guides 56 and their respective rear spring guides 58. However, to achieve a 1 mm change in the preloaded compression distance, tension arm end 76 must be moved about 3 mm. Correspondingly, much less resistance from springs 30 acts against screw 72, thus greatly facilitating manual operation of adjusting mechanism 34.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A chair comprising:

a base including a vertically extending support column;

a seat including a back portion and a bottom portion with a front edge, said seat capable of being positioned in an upright position and a plurality of tilted positions;

a tilt control assembly including a main pivot, a base plate, and a seat plate, said base plate and said seat plate being operatively connected by said main pivot, said main pivot being generally horizontally disposed in the vicinity of said front edge, said base plate attached to said column, and said seat plate attached to said seat;

first spring means operatively connected between said base plate and said seat plate for uniformly resisting tilting by said seat;

second spring means operatively connected between said base plate and said seat plate for variably resisting tilting by said seat including means for providing a relatively high initial resistance against tilting said seat in said upright position and providing a relatively low resistance against tilting said seat in said tilted positions; and adjustment means for adjusting the resistance of said first spring means, said adjustment means including a screw, a tension arm having a pivot and a spring engagement portion, and means for threadedly connecting said screw and said tension arm, said tension arm pivot engaged with one of said plates of said tilt control assembly, said first spring means extending between the other of said plates and engaging said spring engaging portion of said tension arm, said screw threadedly engaged with said tension arm whereby rotation of said screw causes movement of said tension arm, with the distance from said tension arm pivot to said threaded connection means being greater than the distance from said tension arm pivot to said spring engagement portion thereby facilitating movement of said screw by the leverage of said tension arm.

2. The chair of claim 1 wherein the ratio of the distance from said tension arm pivot to said threaded connection means to the distance from said tension arm pivot to said spring engagement portion is at least 2.0.

3. The chair of claim 1 wherein the ratio of the distance from said tension arm pivot to said threaded connection means to the distance from said tension arm pivot to said spring engagement portion is at least 2.5.

4. The chair of claim 1 wherein the ratio of the distance from said tension arm pivot to said threaded connection means to the distance from said tension arm pivot to said spring engagement portion is about 3.0.

5. The chair of claim 1 wherein said first spring means includes at least one compression spring.

6. The chair of claim 5 wherein said first spring means includes two compression springs.

7. The chair of claim 6 wherein each spring includes an axially located guide pin.

8. The chair of claim 7 wherein each spring further includes a spring guide having an arcuate end received in an arcuate seat.

9. The chair of claim 1 wherein said first spring means is rotatably connected to said spring engagement portion to avoid binding and buckling of said spring means as said tension arm rotates.

10. The chair of claim 8 wherein each tension spring has two spring guides located at respective ends of said tension springs, one said spring guide engaging said spring engaging portion of said tension arm, the other said spring guide engaging the other of said plates of said tilt control assembly.

11. The chair of claim 1 wherein said second spring means includes a toggle mechanism with a first arm connected to said seat plate, a second arm connected to said base plate, and a means for pivotally attaching said first and said second arm, at least one of said first and said second arm having a spring for biasing said toggle mechanism to support said seat plate horizontally.

12. A chair comprising:

a base including a vertically extending support column having an upper end;

a seat including a back portion and a bottom portion having a front edge, said seat capable of being positioned in an upright position and a plurality of tilted positions including a maximum tilted position;

a tilt control assembly including a main pivot, a base plate, and a seat plate, said base plate and said seat plate being operatively connected by said main pivot, said main pivot being generally horizontally disposed in the vicinity of said front edge and below an upper planar surface of said base plate, said base plate attached to said column, and said seat plate attached to said seat and having a generally planar lower surface;

spring means for resisting tilting by said seat, said spring means operatively connected between said base plate and said seat plate;

cover means for limiting the tilting movement of said seat, said cover means located at said upper end of said column, said cover means including a spindle cover with a generally planar angled upper surface disposed under said seat plate such that said spindle cover stops movement of said seat at said maximum tilted position and said angled upper surface and said seat plate lower surface are substantially parallel in said maximum tilted position; and toggle means operatively connecting said seat plate and said base plate for resisting tilting of said seat, said spindle cover positioned to stop movement of said toggle means at said upright position.

13. The chair of claim 12 further comprising a control lever for a fluid lifting means, said cover means including means for guiding said control lever.

14. A chair comprising:

a base including a vertically extending support column having an upper end;

a seat including a back portion and a bottom portion having a front edge, said seat capable of being positioned in an upright position and a plurality of tilted positions including a maximum tilted position;

a tilt control assembly including a main pivot, a base plate, and a seat plate, said base plate and said seat plate being operatively connected by said main pivot, said main pivot being generally horizontally disposed in the vicinity of said front edge and below an upper planar surface of said base plate, said base plate attached to said column, and said seat plate attached to said seat and being L-shaped in cross-section having a generally planar lower surface and an extension connected with said main pivot;

spring means for resisting tilting by said seat, said spring means operatively connected between said base plate and said seat plate;

cover means for limiting the tilting movement of said seat, said cover means located at said upper end of said column, said cover means including a spindle cover with a generally planar upper angled surface and a resilient stop cushion disposed over said spindle cover upper service, a top portion of said stop cushion being positioned such that said spindle cover stops movement of said seat at said maximum tilted position and said top portion dampens incident vibration and noise when said seat plate moves to said maximum tilted position and said angled upper surface and said seat plate lower surface are substantially parallel in said maximum tilted position; and toggle means operatively connecting said seat plate and said base plate, said toggle means for resisting tilting of said seat, said spindle cover positioned to stop movement of said toggle means at said upright position.

15. The chair of claim 14 further comprising a control lever for a fluid lifting means, said cover means including a slot for guiding said control lever.

16. A chair comprising:

a base including a vertically extending support column having an upper end;

a seat including a back portion and a bottom portion having a front edge, said seat capable of being positioned in an upright position and a plurality of tilted positions including a maximum tilted position;

a tilt control assembly including a main pivot, a base plate, and a seat plate, said base plate and said seat plate being operatively connected by said main pivot, said main pivot being generally horizontally disposed in the vicinity of said front edge, said base plate attached to said column, and said seat plate attached to said seat;

toggle means for resisting tilting by said seat, said toggle means operatively connected between said base plate and said seat plate; and cover means for limiting the tilting movement of said seat, said cover means located at said upper end of said column, said cover means including a spindle cover and a resilient stop cushion disposed over an edge of said spindle cover, a portion of said stop cushion being positioned such that said spindle cover stops movement of said toggle means at said upright position and said edge portion dampens incident vibration and noise when said seat plate moves to said upright position.

17. The chair of claim 16 further comprising a control lever for a fluid lifting means, said cover means including means for guiding said control lever.

18. The chair of claim 16 wherein said stop cushion also includes a top portion disposed over said spindle cover such that said spindle cover stops movement of said seat at said maximum tilted position and said top portion dampens incident vibration and noise when said seat plate moves to said maximum tilted position.

* * * * *